US005683066A

United States Patent [19]

McCann

[11] Patent Number: 5,683,066

[45] Date of Patent: Nov. 4, 1997

[54] SUPPORT FOR CENTRAL PROCESSING UNIT

[76] Inventor: John Patrick McCann, 6070 Newcomb St., San Bernardino, Calif. 92404

[21] Appl. No.: 566,707

[22] Filed: Dec. 4, 1995

[51] Int. Cl.[6] ..... A47F 1/10

[52] U.S. Cl. ..... 248/295.11; 248/918

[58] Field of Search ..... 248/295.11, 297.31, 248/201, 316.1, 316.4, 316.8, 918, 313, 231.61, 227.3; 211/71, 26, 135; 108/50; 312/223.2, 223.3

[56] References Cited

U.S. PATENT DOCUMENTS

| | | | |
|---|---|---|---|
| 550,443 | 11/1895 | Deal | 248/297.31 X |
| 903,302 | 11/1908 | Moore | 248/295.11 X |
| 963,000 | 6/1910 | Deihl | 248/295.11 |
| 1,411,572 | 4/1922 | Kramer | 248/231.85 |
| 2,986,366 | 5/1961 | Wesson | 248/316.4 X |
| 4,413,801 | 11/1983 | Lancaster et al. | 248/316.4 |
| 4,524,475 | 6/1985 | Valentino | 248/295.11 X |
| 5,403,082 | 4/1995 | Kramer | 108/50 X |
| 5,419,525 | 5/1995 | Hilton | 248/918 X |
| 5,433,414 | 7/1995 | Vieira | 248/316.4 |

FOREIGN PATENT DOCUMENTS

| | | | |
|---|---|---|---|
| 193098 | 11/1957 | Germany | 248/316.4 |

*Primary Examiner*—Ramon O. Ramirez

[57] ABSTRACT

A support for a central processing unit of vertical design which can be adjustably interconnected with a vertical column, such as a table leg, so that the CPU can be conveniently and securely mounted beneath the table top above floor level and out of harms way. The support of the invention is readily adjustable to accommodate CPUs of various sizes and can be positioned at various vertical locations along the table leg.

10 Claims, 4 Drawing Sheets

22
24
20
32
74
78
76
97
95
80
84
90
82
85
87
30
72

SUPPORT FOR CENTRAL PROCESSING UNIT

BACKGROUND OF THE INVENTION

1. Field of the Invention

The present invention relates generally to article supports. More particularly, the invention concerns a support for a computer central processing unit which can be attached to a vertical column such as a table leg.

2. Discussion of the Invention

Personal computer central processing units (CPUs) designed for vertical orientation are becoming increasingly popular. These units, sometimes called "towers", occupy significantly less counter space than do horizontally oriented CPUs and may also be floor mounted. However floor-mounted CPUs often obstruct walkways and are prone to damage by people inadvertently bumping into the unit. Further, floor-mounted CPUs tend to interfere with normal floor cleaning operations. It is desirable, therefore, to provide cabinets or other means which support the CPU above floor level. Accordingly, computer cabinetry has been developed that includes compartments which are specifically designed to accommodate the tower type CPU. Additionally computer stands have been suggested which are specially designed for supporting CPUs. Exemplary of such stands is that disclosed in U.S. Pat. No. 4,949,934 issued to Krenz et al. The Krenz et al stand comprises a rectangular sleeve-like housing into which the CPU is inserted. The lower wall of the housing is supported above floor level by downwardly extending feet.

The thrust of the present invention is to provide a simple, easy-to-use CPU support which can readily be attached to the leg of a table so that the CPU can be supported above the floor and beneath the top of the table. With this arrangement, the CPU does not occupy space on the top of the table, special stands are not required and the CPU is protected from damage. Further, when the CPU is appropriately positioned within the support bracketry of the present invention it is elevated above floor level and does not interfere with normal floor cleaning operations.

SUMMARY OF THE INVENTION

It is an object of the present invention to provide a support for central processing units of vertical design which can be adjustably interconnected with a vertical column, such as a table leg, so that the CPU can be conveniently mounted above floor level.

Another object of the invention is to provide a support of the aforementioned character which is of simple design, is easy to use and can be quickly installed on standard table legs without the need for special tools.

Another object of the invention is to provide a support of the type described in the preceding paragraphs which enables the CPU to be safely and securely mounted beneath the table top and out of harms way.

Another object of the invention is to provide a CPU support of the character described which is readily adjustable to accommodate CPUs of various sizes.

DISCUSSION OF THE INVENTION

Figure 1:
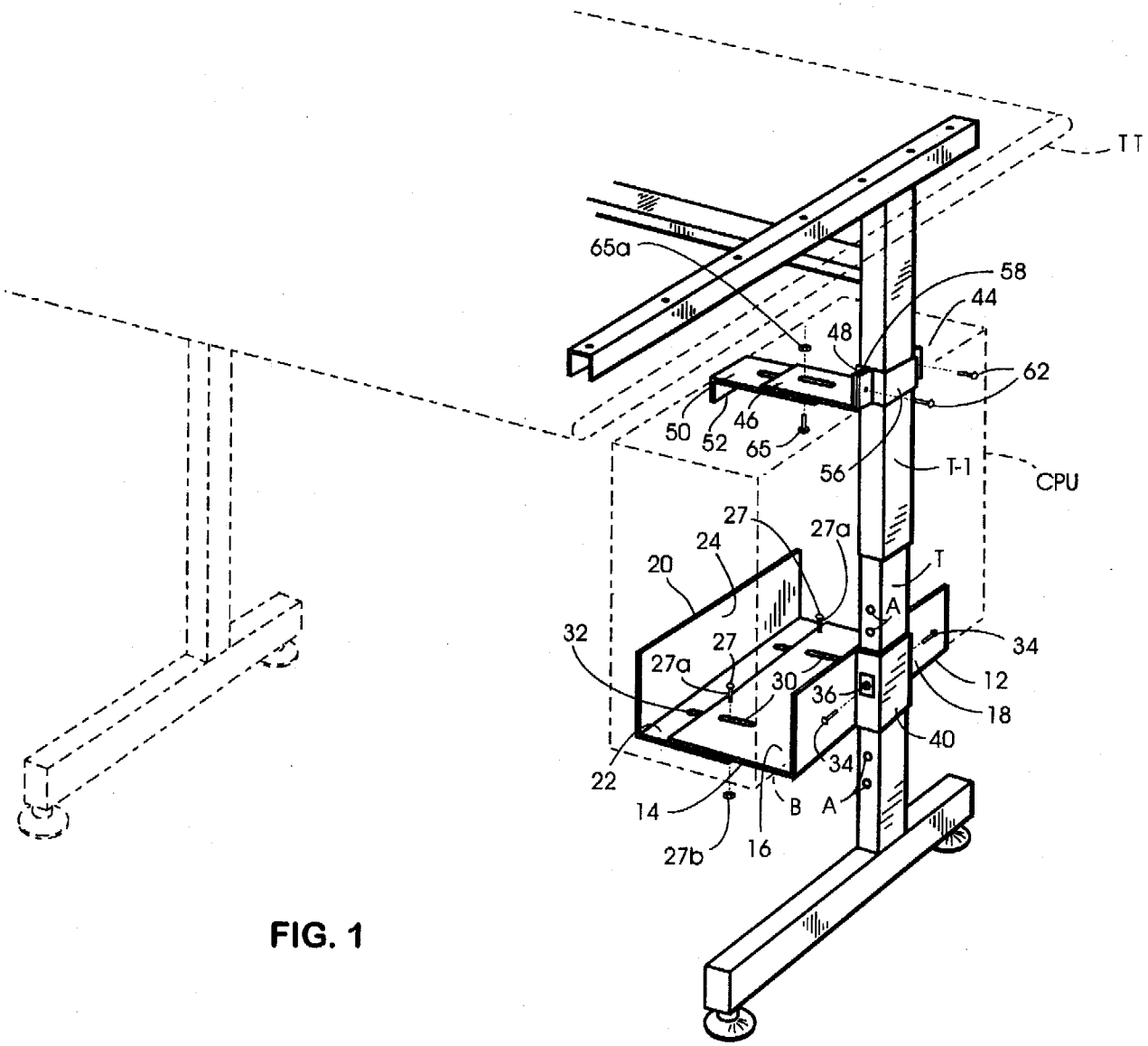
FIG. 1 is a generally perspective, partially exploded view of one form of the support apparatus of the invention shown interconnected with a table of a particular construction.

Referring to the drawings and particularly to FIGS. 1, 2, 2A through 2D and 3, one form of support for a central processing unit of the present invention is there illustrated. In this form of the invention, the apparatus comprises a base assembly 12 for supporting the base portion "B" of a central processing unit shown by dotted lines in FIG. 1 and generally designated as "CPU". Base assembly 12 includes a first member 14 having a base plate component 16 and an integrally formed side wall 18 which is connected to base plate 16 and extends generally perpendicularly upwardly therefrom. Base assembly 12 also includes a second member 20 having a second base plate 22 and an upstanding side wall 24 which is integrally formed with plate 22 and extends generally perpendicularly upwardly therefrom (see also FIGS. 2 and 2A through 2D).

As best seen by referring particularly to FIG. 1, adjustment means are provided for adjustably interconnecting base plates 16 and 22 for movement of base plate 22 relative to base plate 16 between first and second positions to vary the distance between upstanding side walls 18 and 24. In the form of the invention shown in FIG. 1, the adjustment means comprises a pair of threaded connectors 27 having threaded shank portions 27*a* which are receivable through pairs of indexable slots 30 and 32 provided in base plates 16 and 22 respectively. Nuts 27*b* are threadably receivable over the ends of shank portions 27*a* to clamp together plates 22 and 24 in the selected location between their first and second positions. With this construction, by loosening nuts 27*b* relative to threaded fasteners 27, member 20 can be slidably moved relative to member 14 to vary the distance between walls 18 and 24 to accommodate the precise width of the CPU to be supported within the base assembly.

Forming an important aspect of the apparatus of the present invention is first connector means for adjustably connecting first member 14 to the table leg "T". In the embodiment of the invention shown in FIGS. 1, table leg "T" is provided wish a plurality of vertically spaced-apart apertures A which are appropriately sized to receive locking members shown in FIG. 1 as pins 34. Pins 34 are receivable within apertures 36 provided in the opposing side walls of a collar 40 which encircles the table leg in a manner shown in FIG. 1 (see also FIGS. 2, 2C and 2D). Collar 40 is generally tubular shaped so that table leg "T" is telescopically receivable within the collar in a manner to enable the collar to slide vertically of the table leg "T" to a selected position wherein apertures 36 provided in the collar index with selected apertures A provided in the table leg. When the apertures 36 are properly aligned with selected apertures A formed in the table leg, locking pins 34 can be inserted through apertures 36 and apertures A to hold the collar in the selected vertical position along leg "T". It is to be understood that pins 34 may be of various configurations. For example, the pins may be threaded and apertures 36 also threaded to threadably receive pins 34. On the other hand, pins 34 can comprise cylindrical members which are held in position within collar 40 and apertures A of table leg "T" by friction. Also comprising a part of the support apparatus of this first form of the invention is a top assembly generally designated by the numeral 44. Top assembly 44 comprises a first top plate 46 having an integrally formed side wall 48 which extends generally perpendicularly upwardly from plate 46. Top assembly 44 further includes a second top plate 50 having an integrally formed downwardly extending end wall 52 which extends generally perpendicularly to the plane of plate 50 (see also FIG. 3).

Forming a part of the top assembly of the invention is second connector means for connecting first top plate 46 to the upper portion T-1 of the table leg shown in FIG. 1. In this instance, T-1 comprises an upper sleeve which is telescopically receivable over lower leg portion "T" for vertical movement with respect thereto to adjust the height of the table top TT. As best seen by referring to FIG. 3, the second connector means here comprises first and second generally U-shaped members 56 and 58, each of which includes transversely, spaced-apart, outwardly extending connector flanges 56A and 58A respectively. U-shaped members 56 and 58 are configured to closely encircle upper portion T-1 of the table leg in the manner shown in FIG. 1 so that flanges **56*a* and 58*a* are in close proximity. Each of the flange portions 56*a* and 58*a* is apertured to receive threaded connectors 62 (FIG. 1). In the embodiment of the invention here shown, U-shaped member 56 is interconnected with wall 48 of first top plate 56 and each of the flanges 58*a* of member 58 are provided with internally threaded apertures which threadably receive threaded connectors 62 so that upon tightening connectors 62, U-shaped element 56 will be moved into gripping engagement with upper leg portion T-1 of the table. By loosening threaded connectors 62**, the top assembly can be moved vertically along leg portion T-1 to precisely accommodate the height of the CPU which is to be supported within the support apparatus of the invention.

Figure 3:
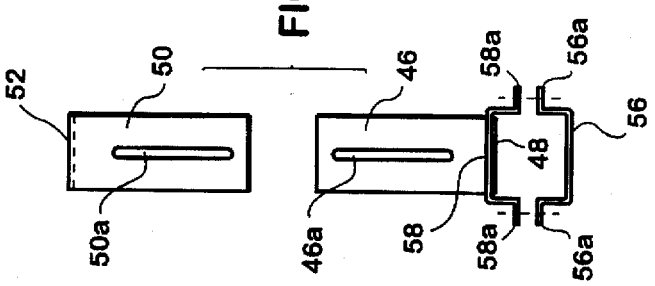
FIG. 3 an exploded top-plan view of the upper securement subassembly of the apparatus shown in FIG. 1.
Figure 2C:
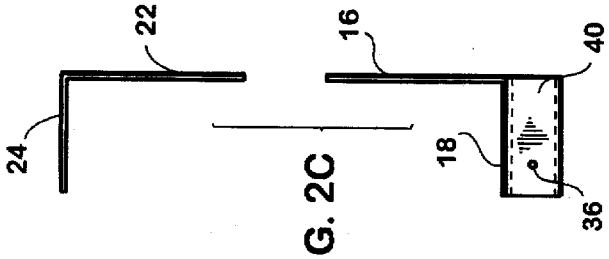
FIG. 2C is a right-side, elevational view of the base support subassembly.
Figure 2B:
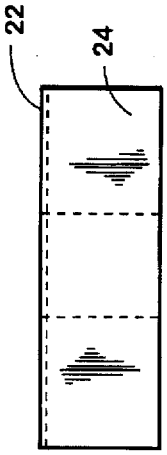
FIG. 2B is a rear-elevational view of the base support subassembly shown in FIG. 1.
Figure 2:
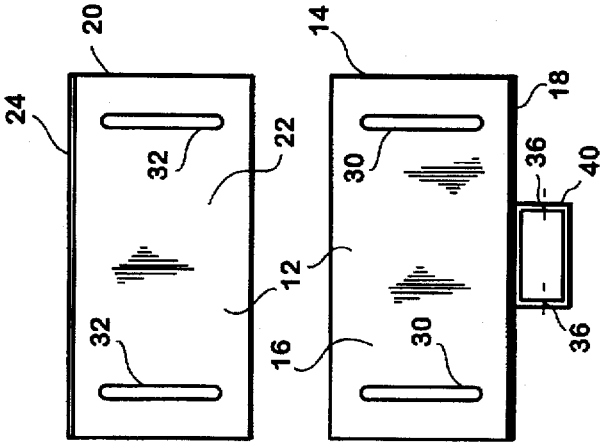
FIG. 2 is an exploded, top-plan view of the base assembly support shown in FIG. 1.
Figure 2A:
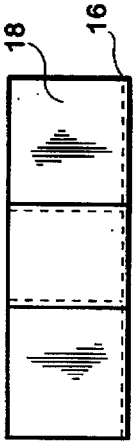
FIG. 2A is a front view of the base support subassembly shown in FIG. 1.
Figure 2D:
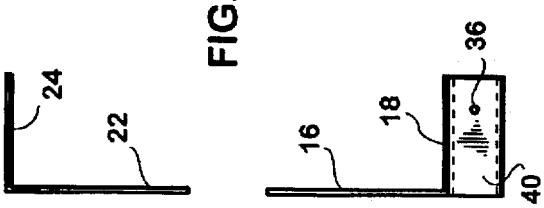
FIG. 2D is a left-side, elevational view of the base support subassembly.

As shown in FIGS. 1 and 3, each of the top plates 46 and 50 is provided with an elongated slot **46*a* and 50*a* respectively. Receivable within slots 46*a* and 50*a* is a threaded connector 65 which has a threaded shank portion adapted to threadably receive a nut 65*a*. With this construction, plate 50 can be adjustably moved relative to plate 46 to accommodate the width of the particular CPU being supported within the apparatus and can be retained in position by tightening nut 65*a* relative to threaded connector 65 to clamp plates 46 and 50** in the desired orientation.

Referring next to FIGS. 4, 5 and 5A through 5D, an alternate form of the support of the present invention is there illustrated. This alternate support is similar in many respects to the support illustrated and described in connection with FIGS. 1 through 3 and like numerals are used to identify like components. In this alternate embodiment of the invention, the apparatus comprises a base assembly 72 for supporting the base portion "B" of a central processing unit shown by dotted lines in FIG. 4 and generally designated as "CPU". Base assembly 72 includes a first member 74 having a base plate component 76 and an integrally formed side wall 78 which is connected to base plate 76 and extends generally perpendicularly upwardly therefrom. Base assembly 72 also includes a second member 20 having a second base plate 22 and an upstanding side wall 24 which is integrally formed with plate 22 and extends generally perpendicularly upwardly therefrom (see also FIGS. 2 and 5A through 5D).

Figure 4:
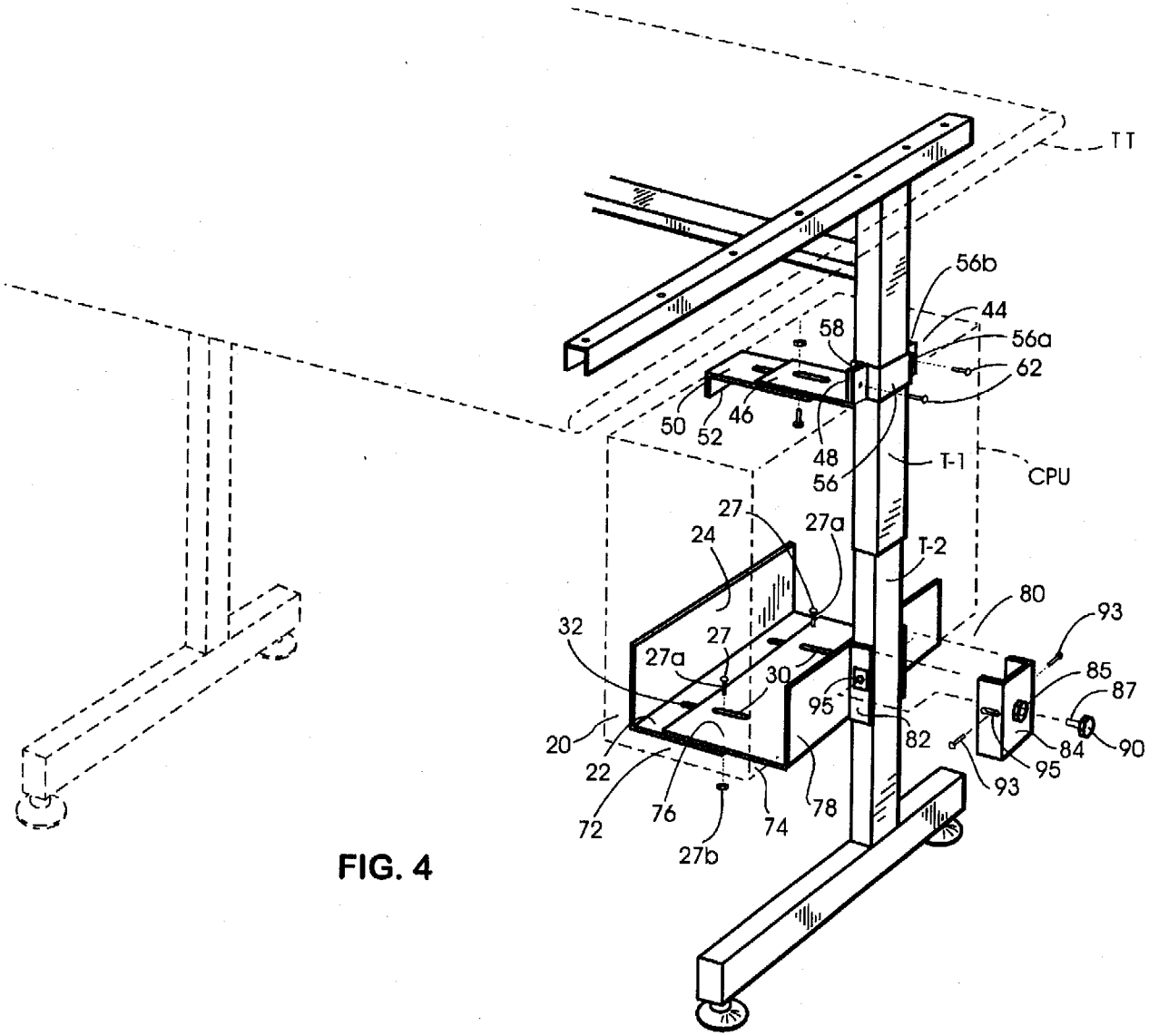
FIG. 4 is a generally perspective, partially exploded view of an alternate form of CPU mount of the present invention which is unable in connection with tables of a different configuration from that shown in FIG. 1.

As best seen by referring particularly to FIG. 4, adjustment means are also here provided for adjustably interconnecting base plates 76 and 22 for movement of base plate 22 relative to base plate 76 between first and second positions to vary the distance between upstanding side walls 18 and 24. As before, the adjustment means comprises a pair of threaded connectors 27 having threaded shank portions **27*a* which are receivable through pairs of indexable slots 30 and 32 provided in base plates 76 and 22 respectively. Nuts 27*b* are threadably receivable over the ends of shank portions 27*a* to clamp together plates 22 and 76 in the selected location between their first and second positions. With this construction, by loosening nuts 27*b* relative to threaded fasteners 27, member 20 can be slidably moved relative to member 74 to vary the distance between walls 78 and 24** to accommodate the precise width of the CPU to be supported within the base assembly.

Forming an important aspect of the apparatus of the present invention is first connector means for adjustably connecting first member 14 to the table leg "T-2". Unlike the embodiment of the invention shown in FIGS. 1, table leg "T-2" does not have vertically spaced-apart apertures, but rather has a generally smooth outer surface.

Figures 5, 5A, 5B, 5C, 5D:
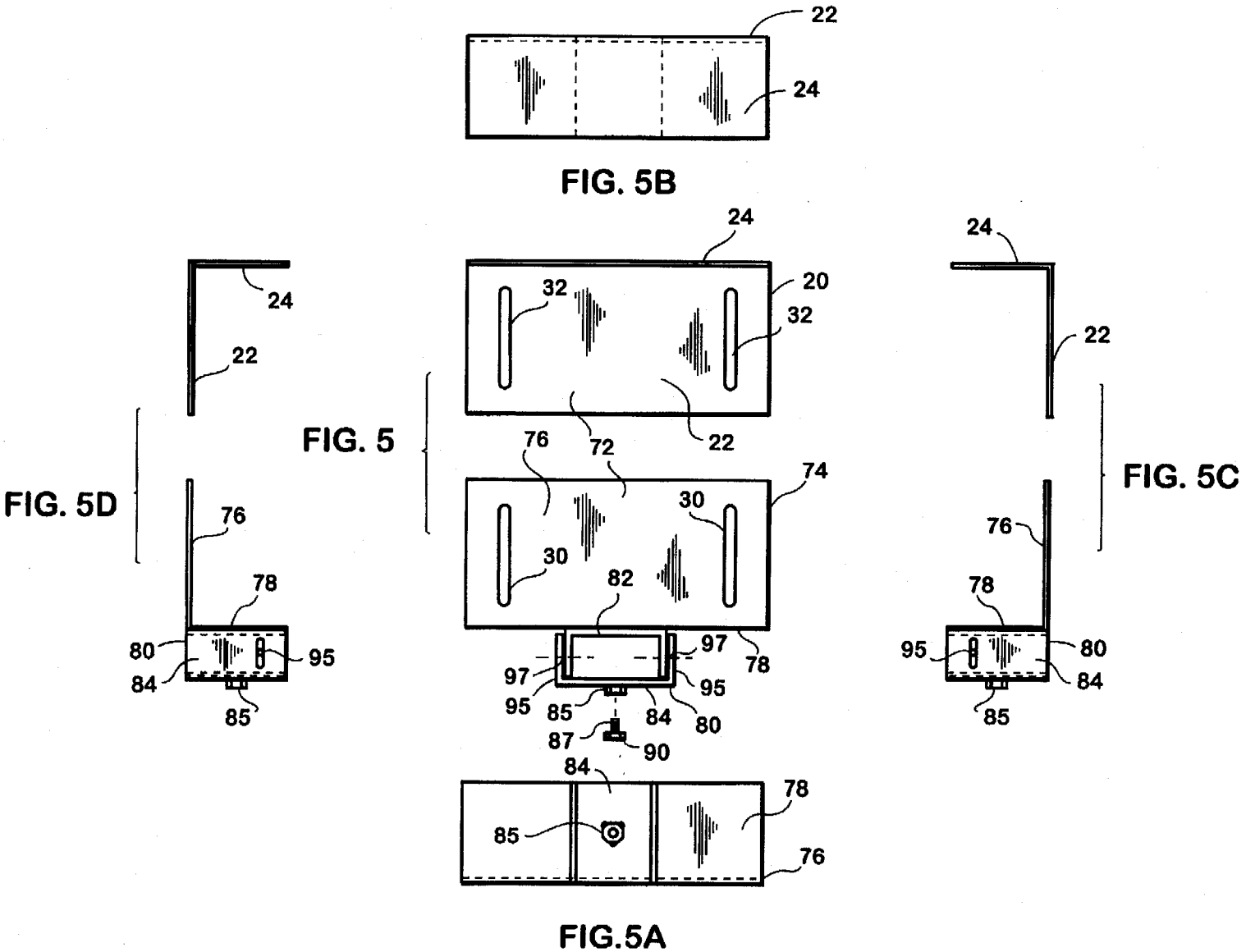
FIG. 5 is an exploded, top-plan view of the base supporting subassembly of the embodiment shown in FIG. 4.
FIG. 5A is a front-elevational view of the base support assembly shown in FIG. 5.
FIG. 5B is a rear-elevational view of the base support assembly.
FIG. 5C is a right-hand, side view of the base support assembly.
FIG. 5D is a left-hand, side view of the base support assembly of this latest form of the invention.

In this latest embodiment, a collar assembly 80 encircles table leg T-2 in a manner shown in FIG. 4 (see also FIGS. 2, 5, 5C and 5D). Collar assembly 80 comprises first and second generally U-shaped members 82 and 84 which are interconnected by screw means, the character of which will presently be described. Member 82 is affixed to wall 78 of the base assembly so that when members 82 and 84 are connected, they encircle the leg in a manner to enable the collar assembly to slide vertically of the table leg "T-2" to a selected height. As best seen in FIGS. 4 and 5, member 84 is provided with a centrally disposed threaded aperture 85, which threadably received the threaded stem 87 of an adjustment knob assembly 90. Assembly 90 comprises a part of the leg-engaging means of this latest form of the invention. When assembly 90 is rotated relative to aperture 85, the extremity of the stem 87 will engage the wall of leg T-2 in a manner to hold the collar in a selected vertical position along leg T-2. More particularly, by rotating knob assembly 90 relative to member 84, the extremity of stem 87 can be moved from a first locking position wherein the stem engages the table leg to a second release position wherein the stem is spaced from the table leg.

The previously identified screw means for interconnecting the U-shaped members 82 and 84 here comprises a pair of oppositely disposed threaded connectors 93 which are received through slots 95 formed in the sides of member 84 (FIG. 4). Connectors 93 are threadably receivable in threaded apertures 97 provided in the sides of member 82 so as to connect the U-shaped members together to form a collar assembly.

Also comprising a part of the support apparatus of this second form of the invention is a top assembly which is identical in construction and operation to top assembly 44.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A support for a central processing unit which can be removably connected to a table leg, said apparatus comprising:

(a) a base assembly for supporting the base of the central processing unit including:

(i) a first member including a first base plate disposed in a first plane and a generally planar upstanding side wall connected to said base plate and extending generally perpendicularly thereto;

(ii) a second member including a second base plate disposed in a second plane parallel to said first plane and a generally planar upstanding side wall connected to said second base plate and extending generally perpendicularly thereto;

(iii) adjustment means for adjustably interconnecting said base plates of said first and second members for movement of said second base plate relative to said first base plate between first and second positions to vary the distance between said upstanding side walls; and (iv) first connector means connected to said generally planar, upstanding side wall of said first member for circumscribing the table leg and for connecting said first member to the table leg at a first location; and (b) a top assembly vertically spaced from said base assembly including;

(i) a first top plate disposed in a first plane and having an integrally formed, upwardly extending end wall;

(ii) a second top plate disposed in a second plane parallel to said first plane and having an integrally formed, downwardly extending end wall, said second top plate being adjustably connected to said first top plate; and (iii) second connector means connected to said upwardly extending top wall of said first top plate for connecting said first top plate to the table leg at a second location vertically spaced from said first location for movement of said first top plate relative to said base assembly.

2. A support as defined in claim 1 in which said first connector means comprises:

(a) a collar encircling the table leg, said collar being connected to said side wall of said first member of said base assembly and being provided with an aperture; and (b) leg engaging means carried by said collar for engaging the table leg to position said collar relative thereto.

3. A support as defined in claim 2 in which said aperture in said collar is threaded and in which said leg engaging means comprises an adjustment knob including a threaded stem threadably receivable within said threaded aperture of said collar for movement upon rotation of said knob between a first locking position wherein said stem engages the table leg to a second release position wherein said stem is spaced from the table leg.

4. A support as defined in claim 1 in which said second connector means comprises first and second generally "U" shaped members, one of said members being connected to said side wall of first top plate.

5. A support as defined in claim 1 in which said second connector means comprises:

(a) first and second generally "U" shaped members each said member including spaced apart outwardly extending connector flanges; and (b) means for releasably interconnecting said connector flanges.

6. A support as defined in claim 5 in which each of said connector flanges is provided with an aperture and in which said means for releasably interconnecting said connector flanges comprise threaded connectors.

7. A support for a central processing unit which can be removably connected to a table leg, said apparatus comprising:

(a) a base assembly for supporting the base of the central processing unit including:

(i) a first member including a first base plate disposed in a first plane and an upstanding side wall connected to said base plate and extending generally perpendicularly thereto, said first base plate having a slot;

(ii) a second member disposed in a second plane parallel to said first plane including a second base plate and an upstanding side wall connected to said second base plate and extending generally perpendicularly thereto, said second base plate having a slot indexable with said slot in said first base plate;

(iii) adjustment means for adjustably interconnecting said base plates of said first and second members for movement of said second base plate relative to said first base plate between first and second positions to vary the distance between said upstanding side walls, said adjustment means comprising a threaded member receivable within said slots formed in said first and second base plates; and (iv) first connector means for connecting said first member to the table leg at a first location, said first connector means comprising a collar for encircling the table leg; and (b) a top assembly including;

(i) a first top plate disposed in a first plane and having an integrally formed, upwardly extending end wall;

(ii) a second top plate disposed in a second plane parallel to said first plane and having an integrally formed, downwardly extending end wall, said second top plate being adjustably connected to said first top plate; and (iii) second connector means for encircling the table leg and for connecting said first top plate to the table leg at a second location spaced apart from said first location for movement of said first top plate relative to said base assembly.

8. A support as defined in claim 7 in which said first connector means comprises a collar encircling the table leg, said collar being affixed to said upstanding side wall of said first member.

9. A support as defined in claim 8 in which said second connector means comprises:

(a) first and second generally "U" shaped members each said member including spaced apart outwardly extending connector flanges; and (b) means for releasably interconnecting said connector flanges.

10. A support as defined in claim 9 in which each of said connector flanges is provided with an aperture and in which said means for releasably interconnecting said connector flanges comprise threaded connectors.

* * * * *